US011162291B2

(12) United States Patent
Reames et al.

(10) Patent No.: US 11,162,291 B2
(45) Date of Patent: Nov. 2, 2021

(54) ADJUSTABLE SLIDER FOR WINDOW REGULATOR

(71) Applicant: Brose Fahrzeugteile GmbH & Co. Kommanditgesellschaft, Bamberg, Bamberg (DE)

(72) Inventors: Chase Reames, Auburn Hills, MI (US); David Nienstedt, Clarkston, MI (US); Brian Fairchild, Oxford, MI (US)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 237 days.

(21) Appl. No.: 16/432,044

(22) Filed: Jun. 5, 2019

(65) Prior Publication Data

US 2020/0386026 A1 Dec. 10, 2020

(51) Int. Cl.
*E05F 11/48* (2006.01)
*E05F 11/38* (2006.01)

(52) U.S. Cl.
CPC ..... *E05F 11/385* (2013.01); *E05F 11/488* (2013.01); *E05Y 2201/64* (2013.01); *E05Y 2201/654* (2013.01); *E05Y 2201/702* (2013.01); *E05Y 2600/20* (2013.01); *E05Y 2900/55* (2013.01)

(58) Field of Classification Search
CPC ... E05F 11/365; E05F 11/488; E05Y 2201/64; E05Y 2201/654; E05Y 2600/20; E05Y 2600/55; E05Y 2011/387
USPC ..... 49/352
See application file for complete search history.

(56) References Cited

U.S. PATENT DOCUMENTS 4,910,917 A * 3/1990 Brauer ..... B60J 1/17 49/348
5,729,930 A * 3/1998 Schust ..... B60J 1/17 49/372
6,453,617 B1 * 9/2002 Klippert ..... E05F 11/385 49/375
6,519,898 B2 * 2/2003 Tatsumi ..... E05F 11/385 49/375

(Continued)

FOREIGN PATENT DOCUMENTS

DE 19956756 A1 9/2001
EP 0505174 A2 9/1992

(Continued)

*Primary Examiner* — Jerry E Redman
(74) *Attorney, Agent, or Firm* — Brooks Kushman P.C.

(57) ABSTRACT

Adjustable slider may include a first jaw, an engagement member, and an adjustment mechanism. The first jaw may extend in a first direction and include a first face. The first face may include a ramped surface that may extend obliquely with respect to the first direction. The engagement member may be configured to be disposed between the window pane and the first jaw. The adjustment mechanism may include an adjustment member that may be configured to rotate about a first rotational axis. The adjustment mechanism may also include a translatable member that may be coupled to the engagement member and configured to translate about the first rotational axis such that rotation of the adjustment member moves the engagement member along the ramped surface of the first jaw.

20 Claims, 5 Drawing Sheets

(56) References Cited

U.S. PATENT DOCUMENTS

| | | | | |
|---|---|---|---|---|
| 6,588,152 | B2 * | 7/2003 | Cabbane | E05F 11/385 49/374 |
| 6,598,345 | B1 * | 7/2003 | Arimoto | E05F 11/385 49/352 |
| 8,453,383 | B2 | 6/2013 | Barr et al. | |
| 8,701,347 | B2 | 4/2014 | Hampel et al. | |
| 2002/0017061 | A1 * | 2/2002 | Nicolai | E05F 11/385 49/375 |
| 2005/0268558 | A1 * | 12/2005 | Cardine | E05F 11/385 49/349 |
| 2009/0007494 | A1 * | 1/2009 | Pavlovic | E05F 11/382 49/349 |
| 2010/0043297 | A1 * | 2/2010 | Barr | E05F 11/385 49/375 |
| 2010/0325962 | A1 * | 12/2010 | Hampel | E05F 11/382 49/157 |
| 2011/0109125 | A1 * | 5/2011 | Kreher | E05F 11/385 296/201 |
| 2014/0086668 | A1 * | 3/2014 | Lee | E05F 11/385 403/187 |
| 2014/0190086 | A1 * | 7/2014 | Yamamoto | E05F 11/385 49/452 |
| 2016/0208535 | A1 * | 7/2016 | Tanaka | E05F 11/385 |
| 2018/0326820 | A1 * | 11/2018 | Huang | E05F 11/488 |
| 2019/0078366 | A1 | 3/2019 | Lu et al. | |
| 2020/0173212 | A1 * | 6/2020 | Pavlovic | E05F 11/483 |
| 2020/0291711 | A1 * | 9/2020 | McCorkell | E05F 11/488 |
| 2020/0386026 | A1 * | 12/2020 | Reames | E05F 11/385 |
| 2021/0054671 | A1 * | 2/2021 | Muller | E05F 15/697 |

FOREIGN PATENT DOCUMENTS

| | | | |
|---|---|---|---|
| EP | 3461981 | A1 | 4/2019 |
| GB | 2313873 | A | 12/1997 |
| GB | 2468405 | B | 5/2013 |
| IT | TO20100915 | A1 | 5/2012 |

* cited by examiner

ADJUSTABLE SLIDER FOR WINDOW REGULATOR

TECHNICAL FIELD

The present disclosure relates to a slider for supporting a window pane for a window regulator for use in a motor vehicle.

BACKGROUND

Vehicles may include a mechanism such has a window lifter or window regulator configured to support and carry a window pane between a first position, e.g., a bottom position, disposed within a cavity of the door or other vehicle member, and a second position e.g. top position, engaged with an upper portion of the door or roof. Window regulators used in vehicle doors that do not include an upper member that receives the window pane may be referred to as a frameless window regulator assembly. Frameless window regulator assemblies are generally used in convertibles or other vehicles that include a window pane that engages a roof rail.

SUMMARY

According to one embodiment, an adjustable slider configured to support and carry a window pane, is provided. The adjustable slider may include a first jaw, an engagement member, and an adjustment mechanism. The first jaw may extend in a first direction and include a first face. The first face may include a ramped surface that may extend obliquely with respect to the first direction. The engagement member may be configured to be disposed between the window pane and the first jaw. The adjustment mechanism may include an adjustment member that may be configured to rotate about a first rotational axis. The adjustment mechanism may also include a translatable member that may be coupled to the engagement member and configured to translate about the first rotational axis such that rotation of the adjustment member moves the engagement member along the ramped surface of the first jaw.

The adjustment member may be a threaded member including a plurality of first threads and the translatable member may include a plurality of second threads. As the threaded member is rotated, the second plurality of threads engage the first plurality of threads.

The translatable member may be a spindle nut.

The first jaw may include a second face that may oppose the first face. The second face may include a cage configured to house the spindle nut. The first jaw may include a second face that may oppose the first face. The engagement member may include a flange that may extend in a direction that may be parallel to the first side. The flange may engage the spindle nut.

The flange may define a notch provided with an inner periphery. The inner periphery of the notch may be configured to engage the spindle nut.

According to another embodiment, an adjustable slider configured to support and carry a window pane is provided. The adjustable slider may include a base member, an engagement member, and an adjustment mechanism. The base member may extend in a first direction. The engagement member may be configured to be disposed between the window pane and the base member. The adjustment mechanism may include a first adjustment member that may extend in the first direction and may be coupled to the base member.

The adjustment mechanism may include a second adjustment member that may extend in a second direction, that may be substantially transverse to the first direction and may be configured to engage the first adjustment member. The adjustment member may also include a translatable member that may be coupled to the engagement member and the first adjustment member. Rotation of the first adjustment member may translate the translatable member along the first adjustment member to move the engagement member along the base member.

The base member may define a receptacle configured to receive at least a portion of the second adjustment member.

The receptacle may be an aperture and the second adjustment member may be configured to rotate in a non-translatable manner within the aperture.

The first adjustment member may include a first head and the second adjustment member may include a second head. The second head may be configured to engage the first head such that as the second head is rotated, the first adjustment member rotates.

The first head of the first adjustment member may be castellated.

The first head may include a plurality of first protrusions and a plurality of first recessed portions. Each of the first recessed portions may be disposed between a pair of protrusions of the plurality of first protrusions.

The second head may include a plurality of second protrusions and a plurality of second recessed portions. Each of the second recessed portions may be disposed between a pair of second protrusions of the plurality of second protrusions.

The base member may include a ramped surface that may extend obliquely with respect to the first direction.

The engagement member may be configured to move between a first position and a second position. When the engagement member is in the first position, a surface of the window pane and a surface of the base member may define a first angle. When the engagement member is in the second position, the surface of the window and the surface of the base member may define a second angle. The second angle may be different than the first angle.

According to yet another embodiment, an adjustable slider configured to support and carry a window pane is provided. The adjustable slider may include a first jaw, an engagement member, a sleeve, and a glass fixation bolt. The first jaw may extend in a first direction and include a first face defining an aperture. The engagement member may define a second aperture. The engagement member may be configured to move along the first face of the first jaw. The adjustable slider may include a sleeve that may include an outer periphery provided with a first protrusion. The first protrusion may be configured to engage an inner periphery of the first aperture. The sleeve may also include an inner periphery that may include a second protrusion. The slider may include a glass fixation member that may be provided with a first portion that may be configured to be received by the inner periphery of the first aperture and engage the second protrusion.

The inner periphery of the sleeve may be configured to engage an outer periphery of the first portion of the glass fixation member in a press-fit manner.

The glass fixation member may be a threaded fastener and moveable between a pre-assembled position and an assembled position, wherein in the pre-assembled position, only the first portion engages the inner periphery of the sleeve, and wherein in the assembled position, the first portion extends through an aperture defined by the window pane.

The second aperture may be an elongated slot that may be configured to translate about the sleeve.

The inner periphery of the first aperture may define a notch configured to engage the first protrusion of the sleeve.

DETAILED DESCRIPTION

Figure 1:
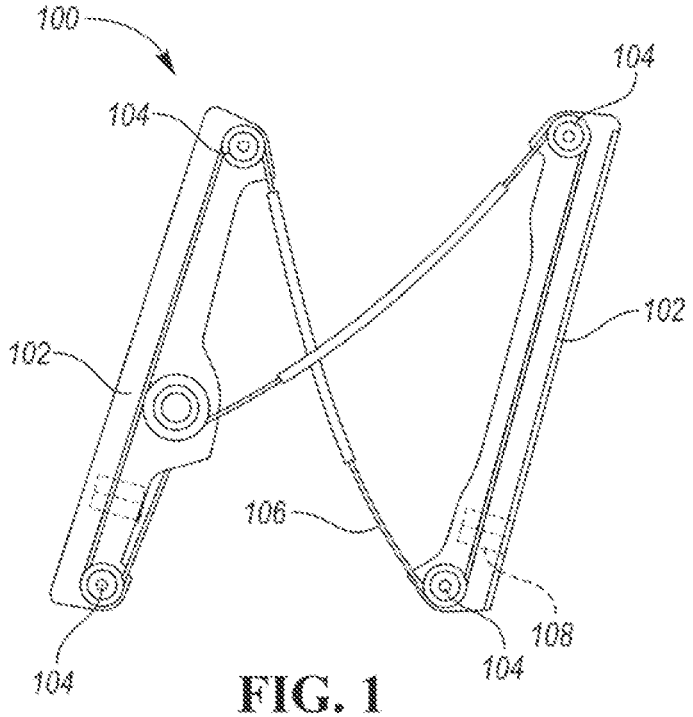
FIG. 1 is a perspective view of an exemplary window regulator assembly.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Window regulators may include one or more guide rails and a slider that may move or translate along the guide rails to adjust a window pane. Frameless window regulators or window regulators configured to move a window pane that does not engage an upper door rail or member may present a number of challenges that may not be associated with conventional window regulators. For example, the relative angular position of the window pane may vary with respect to one or more mating features, such as a roof rail, a seal, or both that are each configured to receive the window pane when the window pane is in a top or uppermost position. If the angular position of the window pane is greater than a predetermined tolerance, the window pane and the seal may not form a sufficient seal.

Because of tolerances and part quality, the angular position of the window pane may vary. Generally, one manufacturer may assemble and ship the window regulator to a vehicle integrator or original equipment manufacturer (OEM) that assembles the window pane to the window regulator and the window regulator and glass to the associated vehicle component, e.g., door. Because an insufficient seal or fit between the window pane and the mating seal or frame member may not be discovered until after the window regulator is shipped and assembled to the vehicle, it may be desirable to provide an adjustment mechanism to adjust the angular position of the window pane. This adjustment may be made by the manufacturer of the window regulator, the OEM, or both. The OEM may inform the window regulator manufacturer of the desired angle or required adjustment so that the manufacturer may set the angle before shipping the window regulators.

Referring to FIG. 1, a perspective view of an exemplary vehicle window regulator assembly 100 is provided. The window regulator 100 may include one or more guide rails 102 that may extend in a vertical direction with respect to the vehicle (not shown). One or more pulleys 104 may be pivotally coupled to the guide rails 102 and one or more cables 106 may be wound around the pulleys 104. An adjustable slider 108 may be provided on the guide rails 102 and one or more of the cables 106.

Referring generally to the figures, the adjustable slider 108 according to one or more embodiments is provided. The adjustable slider 108 may include a first jaw 110 that may extend in a first direction 109. The first jaw 110 includes a first face 111 that may include a ramped surface 112 that may extend in an oblique direction with respect to the first direction 109. An engagement member 116 may be coupled to the first jaw 110 and to an adjustment mechanism 118. The adjustment mechanism 118 may include an adjustment member 120, that may extend in the first direction 109, and a translatable member 122 that may be coupled to the engagement member 116. The adjustment member 120 may be configured to rotate about a first rotational axis 124 such that as the adjustment member 120 rotates, the translatable member 122 and the engagement member 116 moves along the ramped surface 112.

The adjustment member 120 may be a threaded fastener provided with a plurality of first threads 126 that may be configured to engage a plurality of second threads (not shown) formed by an inner portion of the translatable member 122. The translatable member 122 may be a spindle nut that may engage the plurality of first threads 126 so that the adjustment member 120 rotates but does not translate, e.g., move vertically.

In one or more embodiments, the first jaw 110 may include a second face 128 that opposes the first face 111. The second face 128 may include a cage 130 that may be configured to receive and house the translatable member 122. A first side 132 of the first jaw 110 may connect the first face 111 and the second face 128 and extend in a direction that is transverse to the first direction 109. The engagement member 116 may be provided with a flange 134 that may be arranged parallel to the first side 132. The flange 134 may define a notch 136 that may be configured to engage the translatable member 122. That notch 136 may be sized to engage the translatable member 122 in a press-fit manner so that the notch 136 may be selectively detachable from the translatable member 122.

The engagement member 116 may be configured to move along the first jaw 110 between a first position and a second position. When the engagement member 116 is in the first position, a surface 140 of the window pane W and a surface of the first jaw 110, such as the first face 111, may define a first angle $\alpha$. When the engagement member 116 is in the second position, the surface 140 of the window pane W and a surface of the first jaw 110, such as the first face 111, may define a second angle $\beta$. Altering the angles of the window pane W with respect to the first jaw may provide better sealing or mating between the window pane W and the mating vehicle component.

In one or more embodiments, an adjustable slider 200 may be provided with an adjustment mechanism 202 that may include a pair of adjustment members. For example, the first adjustment member 204 may be coupled to a base member 206 and extend in a first direction 208. A second adjustment member 210 may extend in a second direction 212 that may be substantially transverse to the first direction 208. The first adjustment member 204 may include a first head 214 and the second adjustment member 210 may include a second head 216. The first head 214 and the second head 216 may be arranged so that they engage each other. For example, as the first adjustment member 210 rotates, the first head 214 may engage and rotate the second head 216. As another example, the first head 214 may engage the second head 216 to prevent unintended rotation of the second adjustment member 210 and vice-versa.

The first head 214 and the second head 216 may each be castellated. For example, the first head 214 may include a plurality of first protrusions 218 and a plurality of first recessed portions 220. One of the plurality of first recessed portions 220 may be disposed between a pair of protrusions of the plurality of first protrusions. The second head 216 may include a plurality of second protrusions 222 and a plurality of second recessed portions 224. One of the plurality of second recessed portions 224 may be disposed between a pair of protrusions of the plurality of second protrusions 222. As another example, the protrusions and recessed portions may be provided on another portion of the adjustment members 204, 210, such as a shaft that extends from the head.

The first jaw 110 may include a receptacle, such as an aperture 226. The aperture 226 may receive a distal end 228 of the second adjustment member 210. The second adjustment member 210 may have an outer diameter and the aperture 226 may have inner diameter, larger than the outer diameter so the distal end 228 may rotate within the aperture 226.

The adjustable slider 108 may include a sleeve 142 that may receive a glass fixation member 144. The glass fixation member 144 and the sleeve 142 may each be configured move between a pre-assembled position and an assembled position. As one example, the window regulator 100 and adjustable slider may be sent to an assembler, such as an OEM, with the sleeve 142 and the glass fixation member 144 in the pre-assembled position. The assembler may insert the window pane W into the adjustable slider 108 and move the glass fixation member 144 and the sleeve 142 to an assembled position to secure the window pane W to the slider 108.

The sleeve 142 may include an outer periphery 146 and an inner periphery 148. The outer periphery may include a number of protrusions 150 that may engage an inner periphery of an aperture, such as a glass attachment aperture 152 defined by the first jaw 110. The inner periphery 148 may include a number of protrusions 149 that may be configured to engage the glass fixation member 144. In the pre-assembled position, a first portion 154 of the glass fixation member 144 may engage the inner periphery 148 and one or more protrusions 149 in a press-fit manner.

Figure 2:
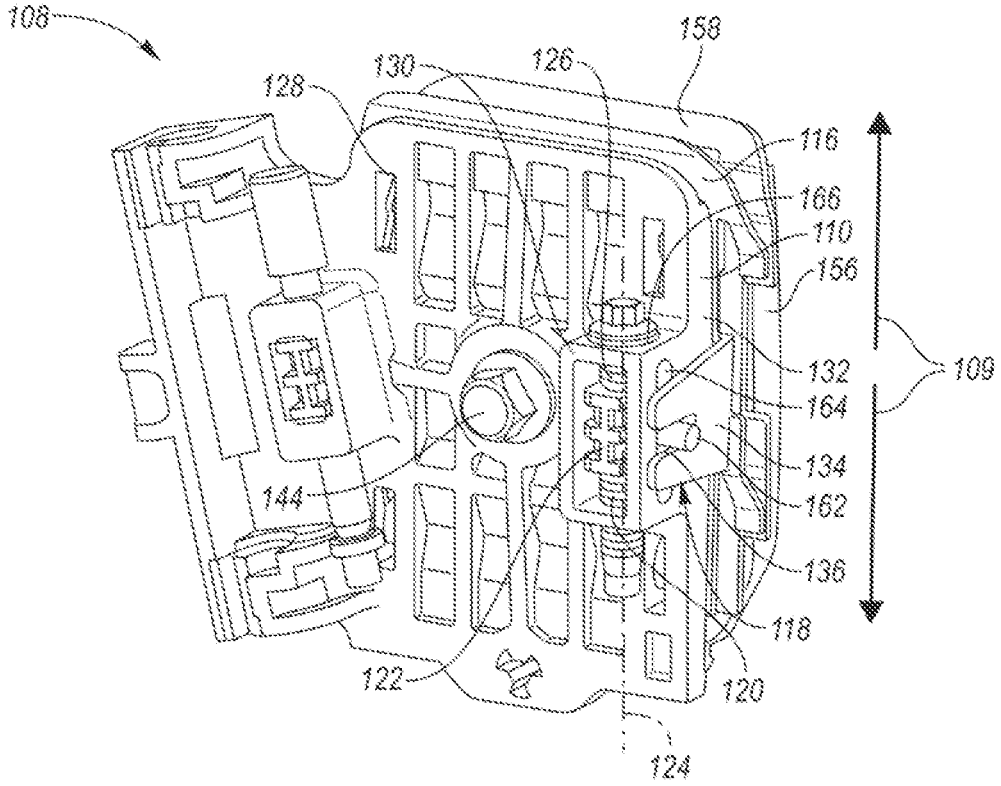
FIG. 2 is a perspective view of an exemplary slider for a window regulator assembly.

FIG. 2 illustrates a perspective view of the adjustable slider 108 according to one or more embodiments. The slider 108 may include a second jaw 156 and a second engagement member 158. The second jaw 156 and second engagement member 158 may oppose the first jaw 110 and the first engagement member 116. In this view, the glass fixation member 144 is in the assembled position. The translatable member may include an arm 162 that may translate along a slot 164 defined by the cage 130. The adjustment member 120 may be include a socket-head that may be engaged by a socket. As another example, the adjustment member may include a head provided with a recessed portion that may be engaged by a tool such as an Allen key. When the window regulator 100 is assembled in a vehicle, one may access the adjustment member 120 from a vertical direction without removing a door panel or other component. A detachable fastener, such as a C-clip 166 may be provided to secure the adjustment member 120 to the first jaw 110.

Figure 3:
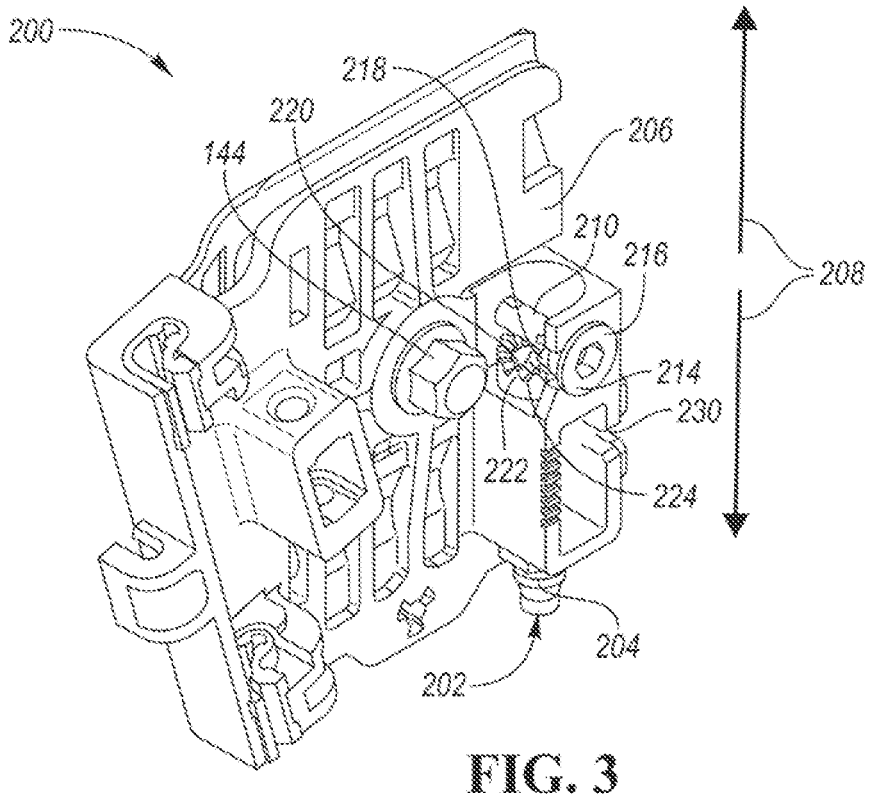
FIG. 3 is a partial-perspective view of an exemplary slider for a window regulator assembly.

FIG. 3 illustrates a perspective view of the adjustable slider 200 provided with an adjustment mechanism 202 that includes a pair of adjustment members. For the purposes of clarity, only the first jaw 110 and first engagement member 116 are illustrated. The cage 130 of the first jaw may include a slot 230. The translatable member 122 may be inserted into and secured with the slot 230 so that an inner periphery of the translatable member 122 is substantially aligned with an aperture that receives the first adjustment member 204. The second adjustment member 210 and the glass fixation member 144 may extend in the same direction e.g., towards the first jaw 110. The orientation of the second adjustment member 210 and the glass fixation member 144 being the same, may provide an ergonomic advantage over the arrangement of the illustrated in FIG. 2. For example, the orientation of the tool used to engage and adjust the second adjustment member 210 may be the same as the orientation of the tool to adjust the glass fixation member 144.

Figure 4:
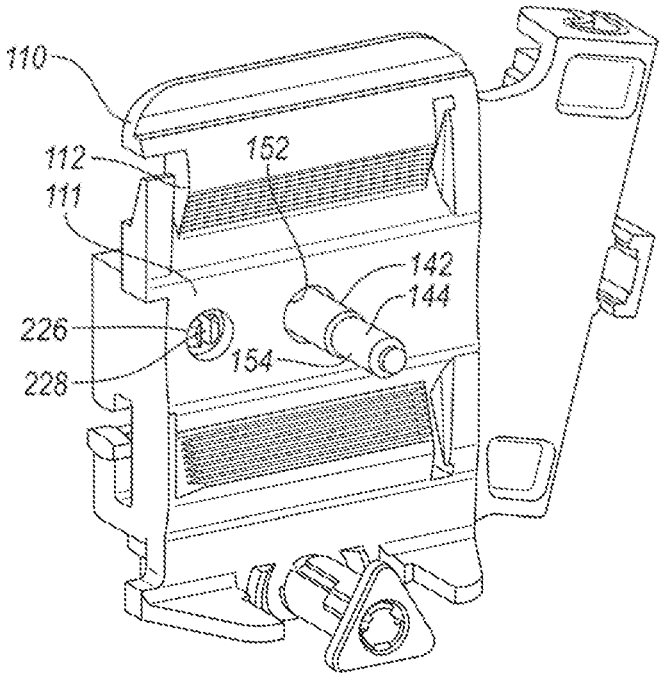
FIG. 4 is a partial-perspective view of the exemplary slider for a window regulator assembly illustrated in FIG. 3.

FIG. 4 illustrates a partial-perspective view of the first jaw 110. For clarity, the engagement member 116 is not illustrated. Here, the glass fixation member 144 and sleeve 142 are shown in the assembled position. The first portion 154 is not engaged with the inner periphery 148 of the sleeve 142. The sleeve 142 extends through the glass attachment aperture 152. The distal end 228 of the second adjustment member 210 is disposed within the receptacle or aperture 226. The ramped surfaces 112 of the first face 111 may include a number of ridges. The ridges may be configured to grip the engagement member 116 when the glass is assembled to the slider.

Figure 5:
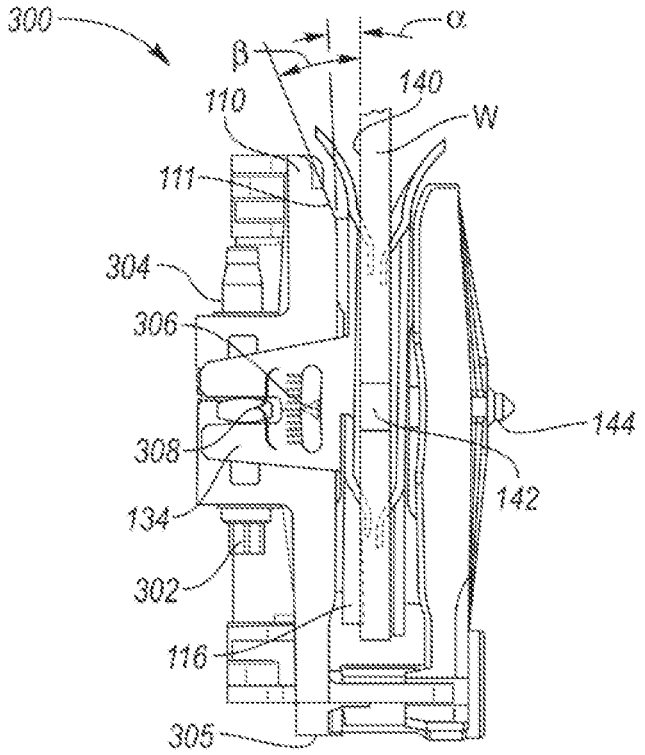
FIG. 5 is a side-plan view of an exemplary slider for a window regulator assembly.

FIG. 5 illustrates a side-plan view of an exemplary adjustable slider 300. As illustrated, a head 302 of the adjustment member 304 may be disposed closer to a bottom portion 305 of the adjustable slider 300. The adjustable slider 300 may include indicia that may indicate the relative portion of the engagement member 116 to the first jaw 110. As one example, the first jaw may include a reference mark, such as an arrow 306, and the flange 134 of the engagement member 116 may include a number of other reference marks, such as lines 308. As another example, the first jaw 110 may include the lines 308 and the flange 134 may include the arrow 306. The lines 308 may be disposed in a predetermined position to indicate the relative position of the engagement member 116 and the first jaw 110.

Figure 6:
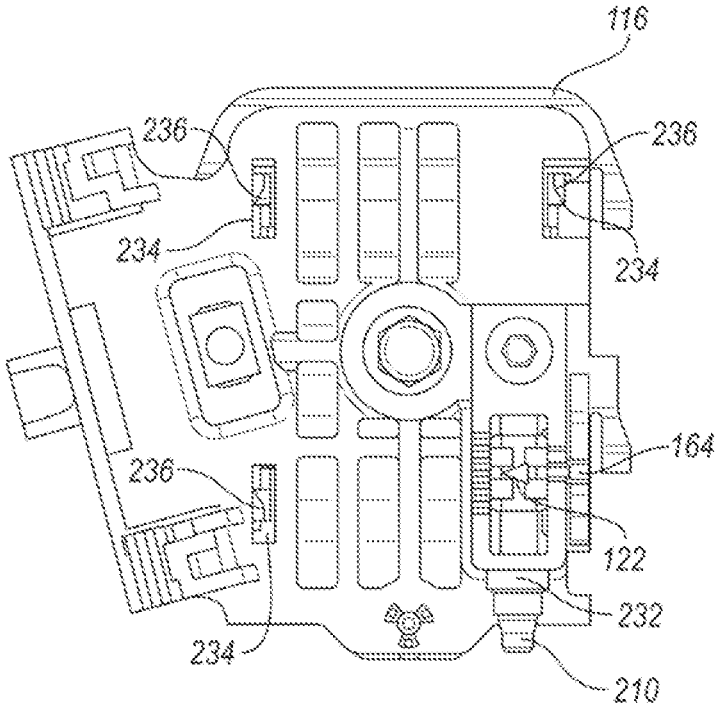
FIG. 6 is a front-plan view of an exemplary slider for a window regulator assembly.

FIG. 6 illustrates a front-plan view of the adjustable slider 200. A fastener such as a nut 232 may engage the second adjustment member 210. The first jaw 110 may include a number of slots 234 that may engage one or more protrusions 236 of the engagement member 116.

Figure 7A:
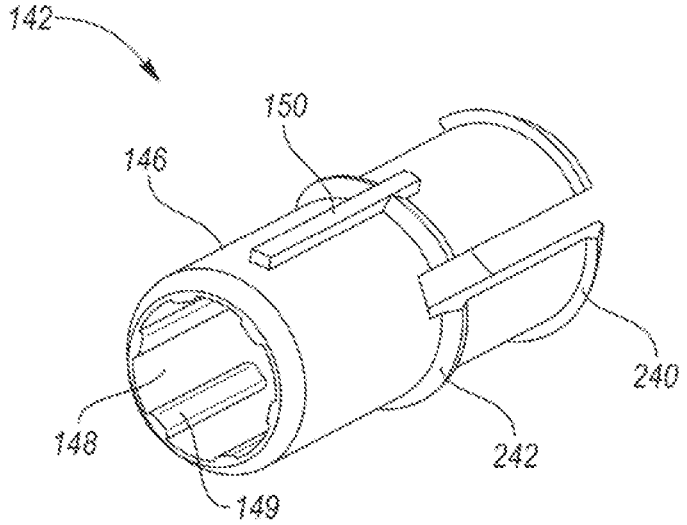
FIG. 7A is a perspective view of an exemplary sleeve for the slider.

FIG. 7A illustrates a perspective view of the sleeve 142. The sleeve may be elongated, having a length longer than the width of the sleeve 142. The sleeve may include a first circumferential protrusion 240 and a second circumferential protrusion 242. The first circumferential protrusion 240 and a second circumferential protrusion 242 may extend around the circumference of the sleeve and serve as stops when the sleeve 142 is inserted into the first jaw 110. The outer periphery 146 of the sleeve 142 may include longitudinal extending protrusions 150 that may be configured to engage an inner periphery of the glass attachment aperture 152.

Figure 7B:
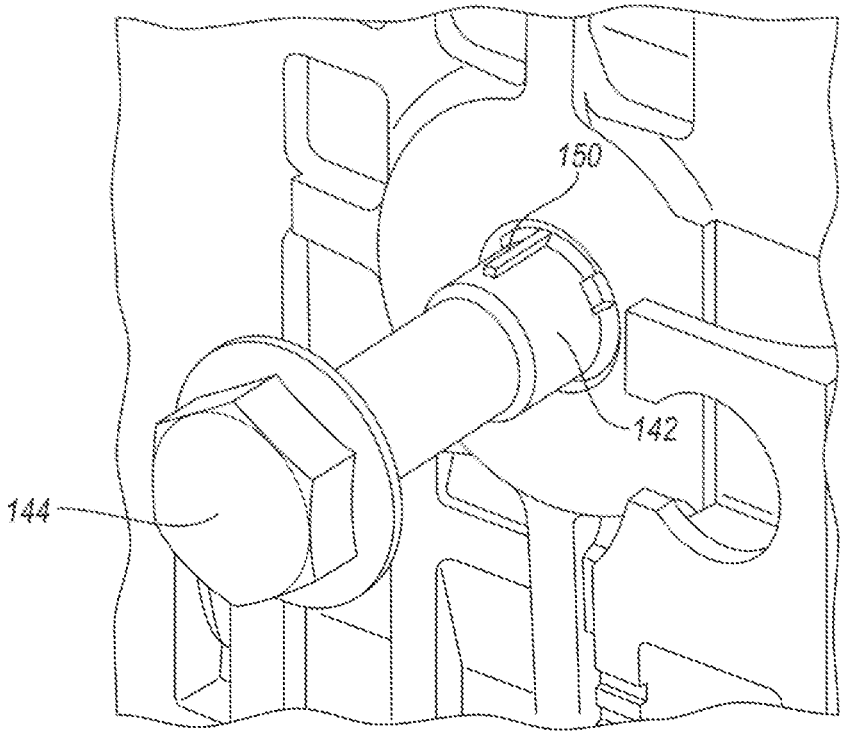
FIG. 7B is a perspective view of the sleeve and a glass-fixation bolt each assembled to a slider and disposed in a first position.
Figure 7C:
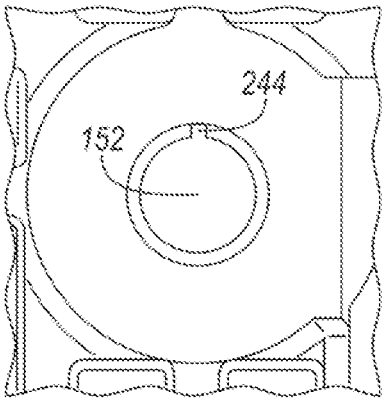
FIG. 7C is a front-plan view of an exemplary jaw or base member of the slider.

Referring to FIG. 7B, the longitudinal extending protrusion 150 is engaged with a notch 244 formed in the inner periphery 246 of the glass attachment aperture 152 (FIG. 7C).

Figure 7D:
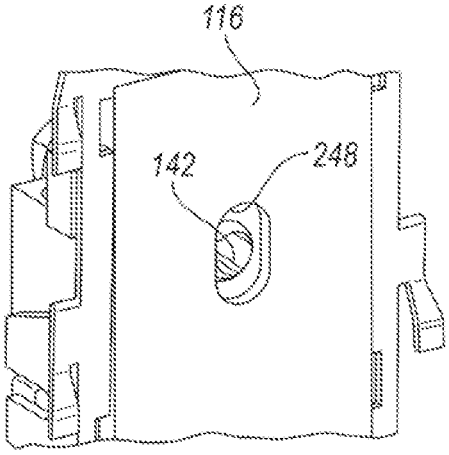
FIG. 7D is a perspective view of an exemplary engagement of the slider.

Referring to FIG. 7D, a perspective view of an inner portion of the engagement member 116 is illustrated. The engagement member 116 may define an elongated slot 248. As the engagement member 116 moves along the first face 111 of the first jaw, the elongated slot 248 may translate about the glass fixation member 144.

Figure 8:
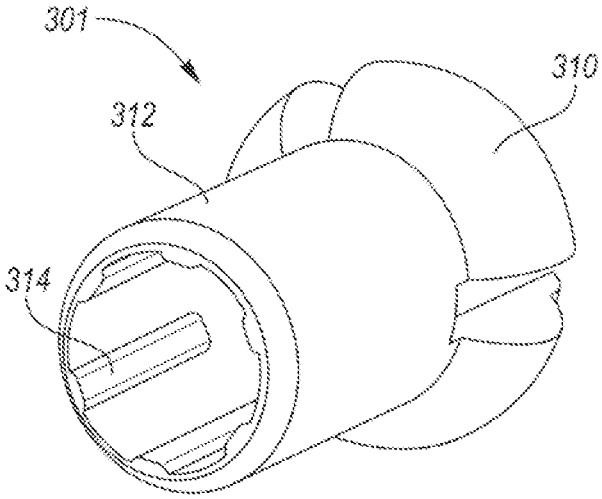
FIG. 8 is a perspective view of an exemplary sleeve for the slider.

Referring to FIG. 8, a perspective view of an exemplary sleeve 301 is illustrated. The sleeve 301 may include a shaft 312 and a bulbous portion 314. The bulbous portion 304 may be configured to engage the inner periphery 246 of the glass attachment aperture 152. An inner portion may include protrusion 306 that are configured to engage the glass fixation member 144.

In one or more embodiments, the first jaw may be formed of aluminum or another suitable alloy. The first jaw may be formed by casting, machining, or additive manufacturing.

In one or more embodiments, the adjustment member 120, 210 may translate to move upwardly, downwardly, or both, with respect to the first jaw 110.

In one or more embodiments, the engagement member 116 may be coupled to the adjustment member direction or indirectly.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

PARTS LIST

100 window regulator
102 guide rails
104 pulleys
106 cables
108 adjustable slider
109 first direction
110 first jaw
111 first face
112 ramped surfaces
116 engagement member
118 adjustment mechanism
120 adjustment member
122 translatable member
124 first rotational axis
126 first threads
128 second face
130 cage
132 first side
134 flange
136 notch
140 surface
142 sleeve
144 glass fixation member
146 outer periphery
148 inner periphery
149 protrusions
150 longitudinal extending protrusion
152 glass attachment aperture
154 first portion
156 second jaw
158 second engagement member
162 arm
164 slot
166 C—clip
200 adjustable slider
202 adjustment mechanism

204 adjustment members
204 first adjustment member
206 base member
208 first direction
210 second adjustment member
210 adjustment members
210 adjustment member
210 first adjustment member
212 second direction
214 first head
216 second head
218 first protrusions
220 first recessed portions
222 second protrusions
224 second recessed portions
226 aperture
228 distal end
230 slot
232 nut
234 slots
236 protrusions
240 first circumferential protrusion
242 second circumferential protrusion
244 notch
246 inner periphery
248 slot
300 adjustable slider
300 exemplary adjustable slider
301 exemplary sleeve
301 sleeve
302 head
304 adjustment member
304 bulbous portion
305 bottom portion
306 arrow
306 protrusion
308 lines
312 shaft
314 bulbous portion The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

What is claimed is:

1. An adjustable slider configured to support and carry a window pane, the adjustable slider comprising:
- a first jaw extending in a first direction and including a first face, wherein the first face includes a ramped surface extending obliquely with respect to the first direction;
- an engagement member configured to be disposed between the window pane and the first jaw; and
- an adjustment mechanism including
  - an adjustment member extending in the first direction, coupled to the first jaw, and configured to rotate about a first rotational axis, and
  - a translatable member coupled to the engagement member and configured to translate about the first rotational axis such that rotation of the adjustment member moves the engagement member along the ramped surface of the first jaw.

2. The adjustable slider of claim 1, wherein the adjustment member includes a plurality of first threads and the translatable member includes a plurality of second threads, and wherein as the adjustment member is rotated, the second plurality of threads engage the first plurality of threads.

3. The adjustable slider of claim 2, wherein the translatable member is a spindle nut.

4. The adjustable slider of claim 3, wherein the first jaw includes a second face wherein the second face opposes the first face, and wherein the second face includes a cage configured to house the spindle nut.

5. The adjustable slider of claim 4, wherein the first jaw includes a first side wherein the first side extends between the first face and the second face, wherein the engagement member includes a flange extending in a direction parallel to the first side, and wherein the flange engages the spindle nut.

6. The adjustable slider of claim 5, wherein the flange defines a notch wherein an inner periphery of the notch is configured to engage the spindle nut.

7. An adjustable slider configured to support and carry a window pane, the adjustable slider comprising:
- a base member extending in a first direction;
- an engagement member configured to be disposed between the window pane and the base member; and
- an adjustment mechanism including,
  - a first adjustment member extending in the first direction and coupled to the base member
  - a second adjustment member extending in a second direction, substantially transverse to the first direction, and configured to engage the first adjustment member, and
  - a translatable member coupled to the engagement member and the first adjustment member, wherein rotation of the first adjustment member translates the translatable member along the first adjustment member to move the engagement member along the base member.

8. The adjustable slider of claim 7, wherein the base member defines a receptacle configured to receive at least a portion of the second adjustment member.

9. The adjustable slider of claim 8, wherein the receptacle is an aperture and wherein the second adjustment member is configured to rotate in a non-translatable manner within the aperture.

10. The adjustable slider of claim 7, wherein the first adjustment member includes a first head and wherein the second adjustment member includes a second head configured to engage the first head such that as the second head is rotated, the first head is rotated.

11. The adjustable slider of claim 10, wherein the first head is castellated.

12. The adjustable slider of claim 10, wherein the first head includes a plurality of first protrusions and a plurality of first recessed portions, wherein each of the first recessed portions are disposed between a pair of protrusions of the plurality of first protrusions.

13. The adjustable slider of claim 12, wherein the second head includes a plurality of second protrusions and a plurality of second protrusions, wherein each of the second protrusions are disposed between a pair of protrusions of the plurality of second protrusions.

14. The adjustable slider of claim 7, wherein the base member includes a ramped surface wherein the ramp surface extends obliquely with respect to the first direction.

15. The adjustable slider of claim 14, wherein the engagement member is configured to move between a first position and a second position, wherein when the engagement member is in the first position, a surface of the window pane and a surface of the base member defines a first angle, and wherein when the engagement member is in the second position, the surface of the window pane and the surface of the base member defines a second angle, different than the first angle.

16. An adjustable slider configured to support and carry a window pane between first and second positions, the adjustable slider comprising:

a first jaw extending in a first direction and including a first face and defining a first aperture;

an engagement member defining a second aperture and configured to be disposed between the window pane and the first jaw;

an adjustment mechanism coupled to the first jaw and the engagement member, wherein the adjustment mechanism is configured to move the engagement member along the first face;

a sleeve including an outer periphery provided with a first protrusion, configured to engage an inner periphery of the first aperture, and an inner periphery provided with a second protrusion; and a glass fixation member including a first portion configured to be received by the inner periphery of the sleeve and engage the second protrusion.

17. The adjustable slider of claim 16, wherein the inner periphery of the sleeve engages an outer periphery of the first portion of the glass fixation member in a press-fit manner.

18. The adjustable slider of claim 16, wherein the glass fixation member is moveable between a pre-assembled position and an assembled position, wherein in the pre-assembled position, only the first portion engages the inner periphery of the sleeve, and wherein in the assembled position, the glass fixation member clamps the window pane to the slider.

19. The adjustable slider of claim 16, wherein the second aperture is an elongated slot configured to translate about the sleeve.

20. The adjustable slider of claim 16, wherein the inner periphery of the first aperture defines a notch configured to engage the first protrusion of the sleeve.

* * * * *